United States Patent [19]

Howell

[11] Patent Number: 4,869,040

[45] Date of Patent: Sep. 26, 1989

[54] FRAMING SYSTEM

[76] Inventor: Bryan M. Howell, 48 Mona Vale Road, Pymble, New South Wales 2073, Australia

[21] Appl. No.: 234,683

[22] Filed: Aug. 22, 1988

[51] Int. Cl.[4] ..... E04B 1/18

[52] U.S. Cl. ..... 52/633; 52/634

[58] Field of Search ..... 52/633, 634, 635, 241, 52/243, 238.1

[56] References Cited

U.S. PATENT DOCUMENTS

| | | | |
|---|---|---|---|
| 1,729,439 | 9/1929 | Gordee | 52/241 |
| 2,990,920 | 7/1961 | Hoffman, Sr. | 52/633 |
| 3,127,961 | 4/1964 | Frazier | 52/633 |
| 4,260,293 | 4/1981 | Peterson | 52/263 X |

FOREIGN PATENT DOCUMENTS

| | | | |
|---|---|---|---|
| 209254 | 7/1957 | Australia | 52/633 |

*Primary Examiner*—David A. Scherbel
*Assistant Examiner*—Creighton Smith
*Attorney, Agent, or Firm*—Beveridge, DeGrandi & Weilacher

[57] ABSTRACT

A framing system for providing structural support to walls and the like which includes a first metal channel with two parallel flanges having two or more longitudinal rows of longitudinally elongated slots. Each elongated slot in one flange lies opposite a corresponding slot in the other flange but each row of slots in each flange is offset from an adjacent row of slots in the same flange. The system further includes a second metal channel section useful as a stud and having two parallel flanges adapted to fit between the parallel flanges of the first section. Both ends of both flanges of the stud section have a plurality of holes in a predetermined pattern such that, when the second section is fitted at right angles into the first section, a sufficient number of holes in each flange of the second section registers with slots in the adjacent flange of the first section so as to enable the first section to be secured to the second section by fasteners passing through the holes and slots in register. The framing system can also include a metal noggin bracket fabricated from a channel section of like dimensions to the second channel section and having a full width transvers slot cut therefrom adjacent its mid-length with the flange portions that define the ends of said lost being slightly deformed such that the second channel sections may be passed through the slot of the noggin bracket and assume a perpendicular alignment.

5 Claims, 2 Drawing Sheets

FRAMING SYSTEM

FIELD OF THE INVENTION

The present invention relates to a framing system for providing structural support to walls and the like and in particular to such a system utilising metal components.

BACKGROUND OF THE INVENTION

Traditionally wall framing has been effected in timber utilising timber studs extending vertically between a top and bottom plate. Noggin members traditionally extend horizontally between adjacent studs to provide additional strength and fixing points. Bracing is additionally necessary in order to maintain the wall unit in a rectangular rather than merely parallelogrammed disposition.

More recently, steel wall framing systems have been introduced wherein steel members are substituted for the top and bottom plates, studs, noggins and braces. Although steel wall framing systems possess some distinct advantages over timber wall framing systems one principal advantage of a timber wall framing system over a steel system that remains is the relative ease with which one timber member may be nailed to an adjacent timber member in an almost infinite variety of configurations. For example if one wishes to vary the standard 450 millimeter stud spacing in a wall in order to accommodate a window or perpendicular abutting wall this change is readily accommodated when utilising timber by nailing a stud in the appropriate position. Where a steel framing system is being utilised the situation however is a little different. Due to the fact that it is time consuming to drill and rivet steel channel sections, steel framing systems have utilised factory pre-prepared fixing systems. For example one system in current use utilises a series of pre-drilled slots which co-operate with lugs or bend-over tabs on adjacent members. Such systems, however, are not capable of achieving the almost infinite variety of spacings which can be achieved with timber, as a lug or bend-over tab must co-operate with a pre-drilled slot and in order to maintain the structural rigidity of a member there is a limit to the number of pre-drilled slots which may be provided and to the closeness of the spacing of such slots. Many steel framing systems are additionally complex to manufacture and require swagging of the ends of channel sections in order to fit into abutting channel sections. Some systems additionally utilise three different channel sections thus necessitating three different manufacturing steps.

OBJECT AND SUMMARY OF THE INVENTION

It is an object of the present invention to provide an improved framing system for walls and the like, which will substantially overcome or ameliorate the above-mentioned disadvantages with existing framing systems.

According to the present invention, there is provided a framing system for providing structural support to walls and the like, said framing system comprising, (i) a first metal channel section adapted for use as a top or bottom plate and having two parallel flanges defining said channel, both said flanges having two or more longitudinal rows of longitudinally elongated slots, each elongated slot in one flange lying opposite a corresponding slot in the other flange but each row of slots in each flange being offset from its adjacent row of slots in the same flange, and (ii) a second metal channel section adapted for use as a stud and having two parallel flanges adapted to fit between the parallel flanges of the first section when the first and second sections are orientated at right angles to each other, both ends of both flanges of the second section having a plurality of holes in a predetermined pattern, wherein, when the second section is fitted at right angles into the first section, a sufficient number of holes in each flange of the second section will be in register with slots in the adjacent flange of the first section so as to enable the first section to be secured to the second section by fasteners passing through the holes and slots in register.

Preferably, both flanges of the first channel section have two longitudinal rows of longitudinally elongated slots, and the ends of both flanges of the second section have four holes spaced apart in a substantially square orientation, which orientation has an axis of symmetry parallel to the longitudinal axis of the second section. In this embodiment, it is preferred that when the second section is fitted at right angles into the first section, at least two holes in each flange of the second section will be in register with slots in the adjacent flange of the first section; the length of the slots, the distance between the slots and the offset relationship between the two rows of slots being such that there is no more than a 5 mm longitudinal increment in each 10 mm length of first section where registration of holes with slots does not occur.

As will be apparent to the skilled addressee, for each flange of the first section, the proportion of total slot area to flange area will effect the degree of structural rigidity of the first section. As one means of achieving increased structural rigidity of the first section, the distance between the elongated slots in each row of slots along both flanges approximates the length of the elongated slots.

Furthermore, one or more of the four holes in either end of the second section may be elongated in a direction transverse to the longitudinal axis of the second section in order to provide a larger range of positions in which such elongated holes may come into register with elongated slots in the adjacent flange of the first section.

Alternatively, the offset relationship of the rows of elongated slots in the first section may be such as to provide a desired degree of vertical overlap between each row of slots.

Preferably, the present invention may further include a metal noggin bracket fabricated from a channel section of the like dimensions to the second channel section and having a full width transverse slot cut therefrom adjacent its midlength with the flange portions that define the ends of said slot being slightly deformed such that a second channel section as hereinbefore defined may be passed through said slot of the noggin bracket so as to assume perpendicular alignment thereto.

BRIEF DESCRIPTION OF THE DRAWINGS

Particular embodiments of the present invention will now be described with reference to the accompanying drawings in which.

DETAILED DESCRIPTION

Figure 1:
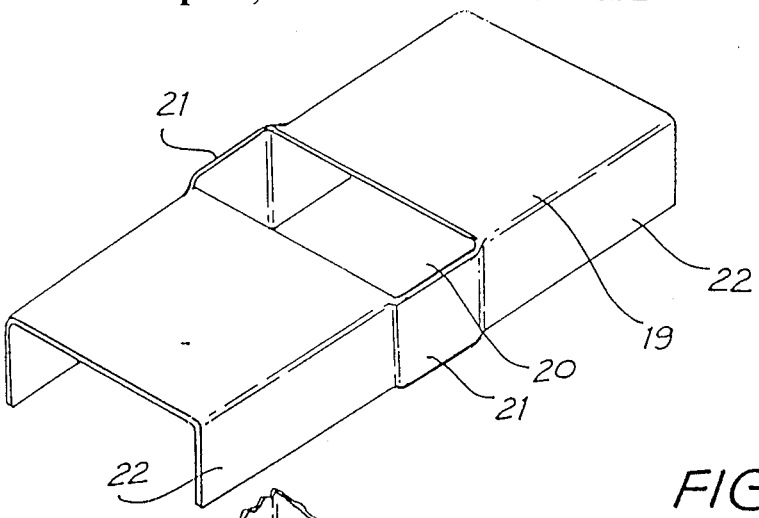
FIGS. 1, 1A and 1B represent in combination perspective exploded view of the prinicipal components components of a framing system according to one embodiment of the present invention.
Figure 1A:
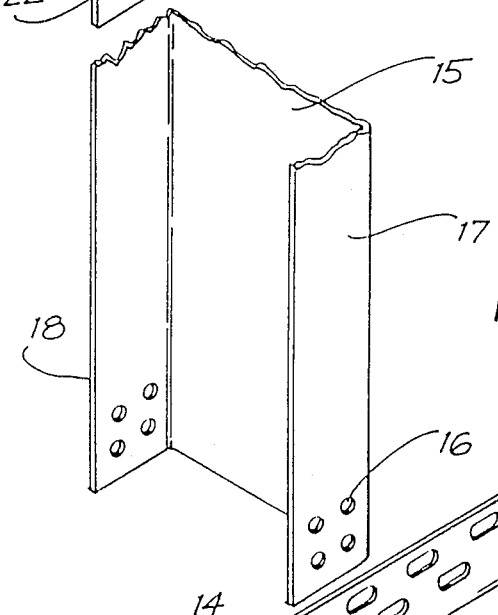
Figure 1B:
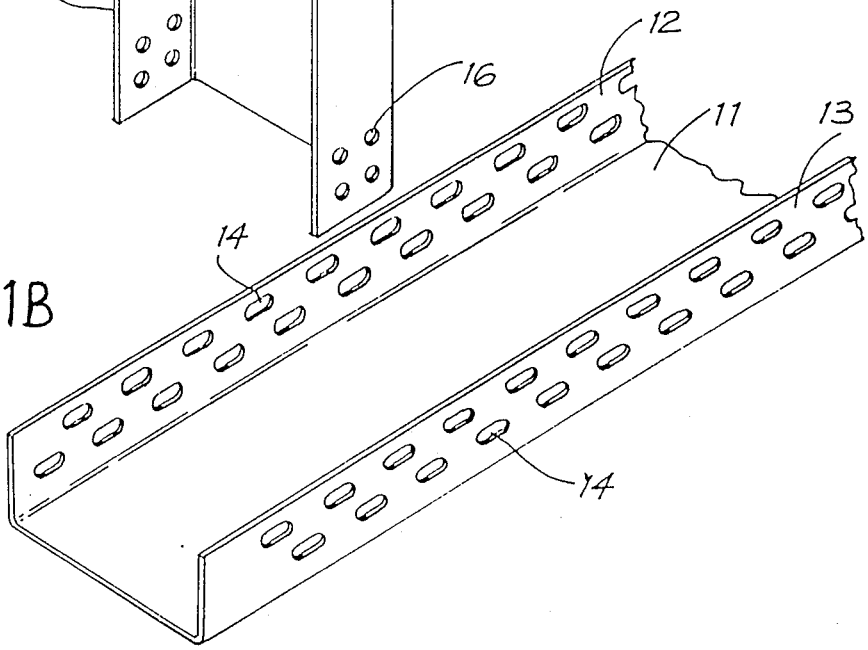

According to FIGS. 1, 1A and 1B, the framing system of the present invention includes a first channel section 11 (FIG. 1B), intended to function as a plate and having flanges 12 and 13, each of flanges 12 and 13 being provided with two rows of elongated slots 14. FIG. 1A depicts a second channel section 13 intended to function as a stud and having four holes 16 punched in either flange 17 and 18 adjacent the end of the channel section 15 and in a substantially square pattern. The dimensions of the second channel section (stud) 15 are slightly smaller than that of the first channel section (plate) 11 in order that the second channel section 15 may be fitted within the first channel section 11. Although the upper extremity of the second channel section 15 is not shown in FIG. 1A it is similarly provided with a set of four holes in each flange in a substantially square pattern to co-operate with a top plate (not shown).

FIG. 1 depicts a noggin bracket 19. The noggin bracket 19 is provided with a transverse aperture 20 in order that such aperture may pass the second channel section 15 and the noggin bracket 19 be located at its preferred site adjacent the mid-length of the second channel section 15. It should be noted that the noggin bracket 19 is fabricated from the same dimension section as that of the second channel section 15 and consequently the flange portions 21 adjacent the longitudinal ends of the aperture 20 are enlarged so as to be capable of passing the second channel section 15. The remaining portions 22 of the flanges of the noggin bracket 19 remain co-planar with the flanges 17 and 18 of the second channel section 15 when the noggin bracket 19 is assembled on the second channel section 15. In this manner, a noggin channel section (not shown) may be of the same section as the top and bottom first channel sections and may simple fit over the section of the noggin bracket and be supported thereby once the noggin bracket is fixed to a second channel section. With this type of assembly it will be noted that only two dimensions of channel section are utilised, the first being for the top and bottom first channel sections (plates) and flanges which are adjacent the longitudinal ends of the aperture of the noggin bracket and the second being for the second channel sections and noggin brackets.

Figure 2:
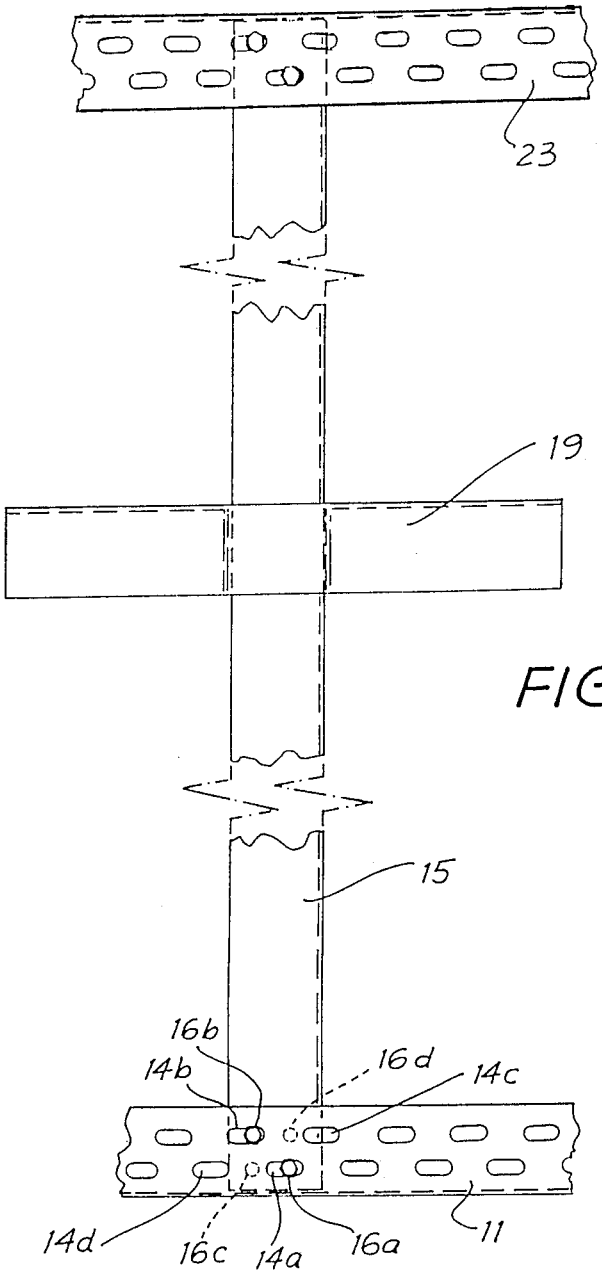
FIG. 2 is a side elevation of the principal components of a framing system according to one embodiment of the present invention in assembled form.

FIG. 2 depicts a bottom first channel section (plate) 11, a second channel section (stud) 15, a noggin bracket 19 and a top first channel section 23 in assembled form. This particular assembly shows the great number of positions in which a second channel section and a top/-bottom first channel section may be fixed with respect to each other. In the example shown in FIG. 2, two elongated slots 14a and 14b in the bottom first channel section 11 are in register with two opposing holes 16*a* and 16*b* respectively in the bottom of the second channel section 15 whereas the remaining two holes 16*c* and 16*d* in the bottom of the second channel section 15 are out of register with the elongated slots in the bottom first channel section 11. It may be observed however that significant movement of the second channel section 15 to the left of the depicted position with respect to the top and bottom first channel sections 23 and 11 respectively is possible without holes 16*a* and 16*b* coming out of register with elongated slots 14*a* and 14*b* in the bottom first channel section 11. Once this movement to the left however causes holes 16*a* and 16*b* to come out of register with elongated slots 14*a* and 14*b* respectively in the bottom first channel section 11 then holes 16*c* and 16*d* will start to come into register with elongated slots 14*a* and 14*c* in the bottom first channel section 11 thereby still facilitating fixing. If the second channel section 15 is moved to the right of its position with respect to the top and bottom first channel sections 23 and 11 respectively as depicted in FIG. 2 then the registration of holes 16*a* and 16*b* with the elongated slots 14*a* and 14*b* in the bottom first channel section 11 will soon be lost but holes 16*c* and 16*d* will soon come into register with elongated slots 14*d* and 14*b* respectively thus facilitating fixing. A similar tolerance of movement can occur with respect to the registration of holes with elongated slots in the top first channel section 23.

It may be observed that the present system will eliminate much wastage as all noggins may be pre-cut to the desired intervals thus determining the spacing of the studs. The studs in turn may be readily fixed at almost any position along a top and bottom plate without the necessity for the drilling of holes. Studs may be fixed to the top and bottom plates by riveting or other known means.

It is important that the elongated slots in each flange of the top and bottom plates are square with the corresponding holes in the opposing flange of the stud as otherwise a stud may be fixed in a slanted fashion.

Bracing is achieved in a conventional manner.

It is apparent that one major advantage of the framing system of the present invention is that all channel sections may be constructed by the roll forming technique. The position, shape and number of slots or holes may be determined at the point of manufacture of the channel section using this technique, thus eliminating the need for subsequent punching of slots or holes into the flanges of the formed channel, which may be time consuming and costly.

Furthermore, once the framing system has been assembled and is being used for instance to support a window of a building, it would not reqire much effort to adjust the position of that window by adjusting the position of the studs along the plates.

Various modifications may be made in details of design or construction without departing from the scope or ambit of the present invention.

What is claimed is:

1. A framing system for providing structural support to walls and the like, said framing system comprising:

(i) a first metal channel section adapted for use as a top or bottom plate and having two parallel flanges defining said channel, both said flanges having two or more longitudinal rows of longitudinally elongated slots, each elongated slot in one flange lying opposite a corresponding slot in the other flange but each row of slots in each flange being offset from its adjacent row of slots in the same flange so as to provide an offset relationship between each row of slots in each flange; and (ii) a second metal channel section adapted for use as a stud and having two parallel flanges adapted to fit between the parallel flanges of the first section when the first and second sections are orientated at right angles to each other, both ends of both flanges of the second section having a plurality of holes in a predetermined pattern, wherein, when the second section is fitted at right angles into the first section, a sufficient number of holes in each flange of the second section will be in register with slots in the adjacent flange of the first section so as to enable the first section to be secured to the second section by fasteners passing through the holes and slots in register, and wherein both flanges of the first channel section have two longitudinal rows of longitudinally elongated slots, and the ends of both flanges of the second section have four holes spaced apart in a substantially square orientation, which orientation has an axis of symmetry parallel to the longitudinal axis of the second section, and wherein two or more of the four holes in either end of the second section are elongated in a direction transverse to the longitudinal axis of the second section in order to provide a larger range of positions in which such elongated holes may come into register with elongated slots in the adjacent flange of the first section.

2. A framing system according to claim 1 wherein, when the second section is fitted at right angles into the first section, at least two holes in each flange of the second section will be in register with slots in the adjacent flange of the first section; the length of the slots, the distance between the slots and the offset relationship between the two rows of slots being such that there is no more than a 5 mm longitudinal increment in each 10 mm length of first section where registration of holes with slots does not occur..

3. A framing system according to claim 1 wherein the distance between the elongated slots in each row of slots along both flanges of the first section approximates the length of the elongated slots.

4. A framing system according to claim 1 which further includes a metal noggin bracket fabricated from a channel section of the like dimensions to the second channel section and having first and second flanges and a full width transverse slot cut therefrom extending between said first and second flanges so as to have ends defined by a portion of each of said flanges with the portions of said flanges that define the ends of said slot being slightly deformed such that a second channel section may be passed through said slot of the noggin bracket so as to assume perpendicular alignment thereto.

5. A framing system for providing structural support to walls and the like, said framing system comprising:

(i) a first metal channel section adapted for use as a top or bottom plate and having two parallel flanges defining said channel, both said flanges having two or more longitudinal rows of longitudinally elongated slots, each elongated slot in one flange lying opposite a corresponding slot in the other flange but each row of slots in each flange being offset from its adjacent row of slots in the same flange; and (ii) a second metal channel section adapted for use as a stud and having two parallel flanges adapted to fit between the parallel flanges of the first section when the first and second sections are orientated at right angles to each other, both ends of both flanges of the second section having a plurality of holes in a predetermined pattern, wherein, when the second section is fitted at right angles into the first section, a sufficient number of holes in each flange of the second section will be in register with slots in the adjacent flange of the first section so as to enable the first section to be secured to the second section by fasteners passing through the holes and slots in register; and said framing system further comprising a metal noggin bracket fabricated from a channel section of the like dimensions to the second channel section and having first and second flanges and a full width transverse slot cut therefrom extending between said first and second flanges so as to have ends defined by a portion of each of said flanges, with the portions of said flanges defining the ends of said slot being slightly deformed such that a second channel section may be passed through said slot of the noggin bracket so as to assume perpendicular alignment thereto.

* * * * *